United States Patent [19]

Fischman et al.

[11] 3,973,545

[45] Aug. 10, 1976

[54] CONTACTLESS IGNITION SYSTEM UTILIZING A SATURABLE CORE TRANSFORMER

[75] Inventors: Martin Fischman, Seneca Falls; John Matarese, Elnora, both of N.Y.

[73] Assignee: GTE Laboratories Incorporated, Waltham, Mass.

[22] Filed: Jan. 23, 1975

[21] Appl. No.: 543,566

[52] U.S. Cl. ..... 123/148 CB; 123/148 E; 123/148 F

[51] Int. Cl.[2] ..... F02P 1/00

[58] Field of Search..... 123/148 E, 148 F, 148 IC, 123/148 OC

[56] References Cited

UNITED STATES PATENTS

| | | | |
|---|---|---|---|
| 3,395,686 | 8/1968 | Minks | 123/148 OC |
| 3,549,944 | 12/1970 | Minks | 123/148 OC |
| 3,808,513 | 4/1974 | Canup | 123/148 E |
| 3,818,885 | 6/1974 | Canup | 123/148 E |
| 3,820,520 | 6/1974 | Canup | 123/148 E |

*Primary Examiner*—Charles J. Myhre
*Assistant Examiner*—Paul Devinsky
*Attorney, Agent, or Firm*—Irving M. Kriegsman; Leslie J. Hart

[57] ABSTRACT

A contactless ignition system includes a free running oscillator which generates an output timing pulse to a pulse generator and an ignition coil whenever the oscillations of a saturable core transformer and a series resonant circuit which is driven by the feedback voltage induced in the transformer secondary winding cease. In the free running state, the feedback voltage sustains the oscillator operation at a frequency fixed by the resonant circuit. A disk, having a plurality of permanent magnets evenly spaced around its periphery, is affixed to the distributor shaft and disposed within the vicinity of the saturable core of the transformer. As the disk rotates, the magnetic field of each magnet, as it passes the vicinity of the core, momentarily saturates the transformer core. Saturation of the core reduces the feedback voltage below the oscillation sustaining level and, consequently, causes the oscillator to generate an output pulse which is synchronous with the engine speed. Means are provided for making the rise time of the output pulse independent of the engine speed, thereby facilitating the use of this system at extremely low cranking speeds.

5 Claims, 4 Drawing Figures

CONTACTLESS IGNITION SYSTEM UTILIZING A SATURABLE CORE TRANSFORMER

BACKGROUND OF THE INVENTION

The present invention relates to electrical ignition systems for internal combustion engines and, more specifically, to a contactless ignition system utilizing a saturable core transformer.

Recently, significant effort has been directed to the development of a contactless ignition system for internal combustion engines. The contact ignition system has certain disadvantages which may best be understood by reviewing briefly the basic operation of the conventional ignition system which utilizes contacts. In the conventional system, the vehicle DC power source, such as the battery or generator, provides a DC current to a primary circuit comprising the series connection of the ignition switch, the primary coil of an ignition coil assembly and a pair of contacts which are opened and closed in response to the rotation of the distributor shaft. The primary coil is magnetically coupled to a secondary coil which has a greater number of turns than those in the primary coil. Current flows in the primary circuit when the distributor contacts are closed. This current causes a magnetic field to build up in the primary coil. When the distributor contacts open, the current in the primary circuit tends to continue to flow. A capacitor which is connected across the distributor contacts provides a reservoir for this current, and reduces the tendency for the current to arc across the open distributor contacts. When the current decreases, the magnetic field decreases, and this sudden change in the magnetic field induces a high voltage into the secondary coil of the ignition coil assembly. This voltage is sequentially directed across each of the sparkplugs resulting in an arc which ignites the mixture of gasoline and air in the cylinder.

There are two basic reasons why contact ignition systems require periodic maintenance. The first reason is contact deterioration which is a result of the inability to prevent some arcing from occuring across the contacts. The second is the wearing down of the rubbing block which results in changes in the contact or dwell angle and in the spark timing. The rubbing block which is affixed to the distributor shaft is the cam which opens and closes the contacts. Thus, the use of distributor contacts is the primary reason for frequent ignition system maintenance.

Several contactless ignition systems have been developed, but none have been developed which do not introduce additional problems. One common problem with these systems is their inability to operate as effectively at slow cranking speeds as they do at higher speeds.

One of the first systems in the direction of the semiconductor ignition system did not actually eliminate the contacts, but instead, it reduced the current flowing through them. The contacts were connected in series with the base circuit of a transistor, the collector and terminal electrodes being connected in series with the primary coil. While this system reduced the current through the contacts by placing the contacts in a relatively low current transistor base circuit, it did not solve the problem of rubbing block wear and deterioration. In another known circuit, the contacts were replaced by a magnetic assembly which was mounted on the rotor of the distributor and a pulse amplifier network.

The assembly included a number of permanent magnets which were evenly spaced around the rotor and a group of stationary pickup windings. The rotating magnets altered the magnetic field which is coupled to the stationary windings to provide pulses to the amplifier in synchronism to the crankshaft rotation. The amplifier output is applied to the low voltage winding of the ignition coil. While this system eliminates the contacts and their attendant problems, this system does not operate effectively at low cranking speeds since the size of the pulse is related to the speed of the rotor; as the pulse becomes smaller, noise in the system has an increased disadvantageous effect.

The Huntzinger U.S. Pat. No. 3,357,416 addressed its teachings to this problem which is stated in the patent to be as follows:

> "The potential pulses produced by a magnetic pulse generator of this type are of a low amplitude at the slow rotational breaker cam speeds encountered during cranking, thereby necessitating a large amplification of the developed signal. The large amplification required renders the system extremely sensitive to spurious signals, produced by mechanical vibration and electrical transient impulses present in the power system, which may create ignition signals at unwanted times."

The Huntzinger patent discloses an ignition system including a magnetic pulse generator in which the flux coupling a pickup coil relates to the position of the distributor rotor, an electronic integrator and amplifier for integrating the pulse to reduce the effect of spurious noise, a multivibrator driven by the integrator output and a normally conducting transistor whose collector and emitter electrodes are in series with the primary coil, the transistor base being driven by the multivibrator. The current in the coil is interrupted when the magnetic pulse occurs. While this circuit does reduce the electrical noise problems, this system consumes significant power and is not economical to manufacture due to its relatively complicated circuit.

Another system is described in U.S. Pat. No. 3,407,795 to Aiken et al. In this patent, a Jenson oscillator provides an AC signal which drives a transformer, the output of which is applied to the proper sparkplug. Another transformer provides a feedback signal for the oscillator. A set of conventional contacts controls the current through one winding of the feedback transformer such that the feedback transformer is saturated before the time for firing. When the points open, the oscillator starts, thereby providing an AC signal to the sparkplug. Another network which includes a silicon controlled rectifier provides an alternate path for the current for the saturating winding of the feedback transformer to stop the AC voltage to the sparkplug at a time after the opening of the contacts, the time being independent of the engine speed. This system, while teaching the use of an oscillator, utilizes conventional contacts. The magnetic field for saturation of the feedback transformer is created by an electrical current flowing through a winding. This current creates an added power drain and may deteriorate the contacts since this current flows through them.

Various other ignition systems, and magnetic pickup devices have been described in the prior art, such as U.S. Pat. Nos. 3,434,463, 3,575,150, 3,675,635, 3,500,809, 3,484,677 and 3,658,039. However, the prior art of which the inventor is aware neither discloses nor suggests a contactless ignition system of the type described and claimed in the present invention.

SUMMARY OF THE INVENTION

In accordance with the present invention, there is provided an ignition system which overcomes the problems previously mentioned. More specifically, the ignition system does not utilize contacts thereby overcoming the problems of contact deterioration and rubbing block wear and provides synchronous timing pulses through the full range of engine speeds including low cranking speeds.

The ignition system of the present invention has a free running oscillator which provides oscillations at a fixed frequency. An electromagnetic feedback coupling network sustains the oscillations. The output circuit of the oscillator provides a pulse to the ignition coil only when the oscillations stop. Means are provided for periodically saturating the electromagnetic feedback network to stop the oscillations in synchronism with the engine speed. In addition, a device is provided for making the rise time of the output pulse independent of the engine speed so that the ignition system provides adequate ignition pulses at very low cranking speeds. The feedback network includes a transformer having a saturable core and the saturating means includes a rotating disk and a plurality of permanent magnets mounted thereon. As each magnet moves past the core, it momentarily saturates the core, thereby stopping the oscillations. The device for insuring fast rise times for the output pulses, preferably, is a capacitor coupled across the input circuitry of the oscillator.

In a preferred embodiment of the present invention, the ignition system includes an oscillator having, amongst other features, a first and second transistor having first, second and third electrodes, a series resonant circuit having first and second ends and a saturable core transformer having a first, second and third winding, each winding having a first and second terminal. The first electrodes of the transistors are coupled together, and the first terminal of the first and second windings are connected to the second electrode of the first and second transistors, respectively. The second terminals of the first and second windings are connected together to form a centertap. The first terminal of the third winding is connected to the second end of the resonant circuit, the first end of the resonant circuit being connected to the third electrode of the first transistor. The second terminal of the third winding is connected to the third terminal of the second transistor. First and second diodes are coupled across the first and third electrodes of the first and second transistors, respectively. A loading capacitor is coupled across one diode to provide rapid cutoff of the transistors at slow engine cranking speeds. A resistance coupled power source is applied to the centertap; and an output capacitor is coupled between an amplifier and the centertap. The transformer core is periodically saturated by a magnetic field from a disk assembly including a disk, and a plurality of permanent magnets mounted on the disk, the disk rotating in synchronism with the engine.

There are several advantages of the present invention over the prior art ignition systems. The present invention does not use contacts, and the means for saturating the transformer core does not consume any electrical power, such as is the case in the Aiken et al. patent. Further, the magnetic disk assembly controls the feedback to an oscillator that generates high amplitude triggers. Such a feature is different from a magnetic pickup assembly which creates a weak signal which in turn is amplified and applied to the ignition coil. Thus, the present invention does not require complicated circuitry, such as that described in the Huntzinger patent. Lastly, the present invention insures that the output timing pulse has a rise time which is determined by circuit parameters rather than the engine speed, thereby permitting the system to operate effectively at low engine cranking speeds.

DESCRIPTION OF THE PREFERRED EMBODIMENTS

Figure 1:
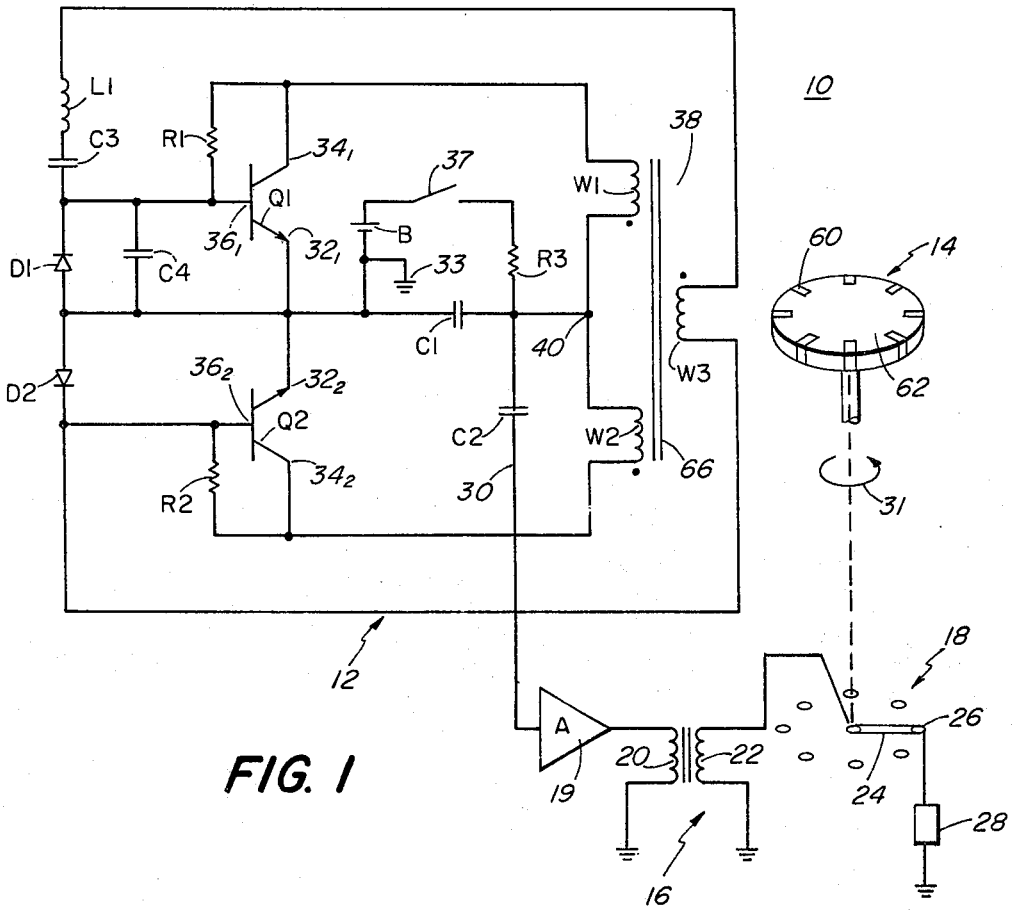
FIG. 1 is a circuit diagram of the ignition system according to the present invention.

In an exemplary embodiment of the present invention as shown in FIG. 1, a contactless ignition system for internal combustion engines is illustrated which utilizes a saturable core transformer to provide adequate sparking down to almost zero cranking speeds. The ignition system represented generally by the reference numeral 10, includes an oscillator 12, a magnetic disk assembly 14, an ignition coil assembly 16, a distributor rotor assembly 18 and a pulse generator 19. The ignition coil assembly 16 includes primary and secondary coils 20 and 22, respectively, the secondary coil having a substantially greater number of turns than the primary coil. This coil assembly 16 receives the output voltage of the oscillator 12, steps up this voltage and applies the voltage to the distributor rotor assembly 18. The oscillator provides a trigger for driving the pulse generator 19. This pulse generator increases the trigger level sufficiently to provide adequate spark power. The pulse generator could be a transistor or an SCR device. The voltage from the coil 22 is applied across the series connection of a rotor arm 24, a contact 26 and a sparkplug 28. The rotor arm 24 rotates in response to the rotation of the engine crankshaft, and the number of sparkplugs 28 and contacts 26 correspond to the number of engine cylinders. FIG. 1 shows the operation for an eight cylinder engine, but it is to be understood that the ignition system is applicable to any internal combustion engine.

The oscillator 12 provides pulses on an output lead 30, the pulses being in synchronism with the engine crankshaft rotation. The pulse synchronism is controlled by the magnetic disk assembly 14 which rotates, as indicated by an arrow 31, at a speed equal to the rotational speed of the engine crankshaft. The oscillator 12 is similar in some respects to the oscillator described in U.S. Pat. No. 3,119,972 to Fischman, who is also the co-inventor in the present invention. However, the oscillator 12 of the present invention has several structural features which are not disclosed or suggested in the earlier patent.

Referring now to the oscillator 12, first and second transistors Q1 and Q2, respectively, shown as PNP transistors in FIG. 1, are connected in a push-pull arrangement. The first electrodes (emitter) $32_1$ and $32_2$ of the transistors Q1 and Q2, respectively, are coupled together and are grounded at 33. The second electrode (collector) $34_1$ of transistor Q1 is connected to a first terminal of a first primary winding W1 of a saturable core transformer 38. Likewise, the second electrode (collector) $34_2$ of the transistor Q2 is connected to a first terminal of a second primary winding W2 of the transformer 38. The second terminals of the first and second windings W1 and W2 are connected together to form a centertap 40. First and second starting resistors R1 and R2 are coupled across the collector and base electrodes of the transistors Q1 and Q2, respectively. A capacitor C1 is connected between the emitters of the transistors Q1 and Q2 and the centertap 40. A source of DC power, such as a 12 volt battery B and/or a generator (not shown), is connected to the centertap 40 via the series connection of an automobile ignition switch 37 and a resistor R3. The output of the oscillator is taken from the centertap 40 through an output capacitor C2. A voltage induced on a secondary winding W3 of the saturable core transformer 38 is applied to a feedback network for the oscillator 12. One side of the secondary winding W3 connected to the base $36_1$ of the first transistor Q1 and to the cathode of a first diode D1 via a resonant circuit, comprising the series connection of an inductor L1 and a capacitor C3. The other side of the winding W3 is connected to the base $36_2$ of the transistor Q2 and to the cathode of a second diode D2.

The anodes of the diodes D1 and D2 are coupled together and grounded. A loading capacitor C4 is connected across the first diode D1.

Referring again to FIG. 1, a plurality of small permanent magnets 60 corresponding to the number of cylinders in the engine are embedded around the periphery of a disk 62 which is attached to and rotates with the distributor shaft (not shown). One pole of the magnet is at the outer surface of the disk. The transformer 38 comprises a small ferrite memory core 66 with the windings W1 and W2 and W3 wound thereon, the core 66 being placed in close proximity to the outer surface of the rotating disk 62. As the disk 62 rotates, each magnet 60 passes close to the ferrite core 66, momentarily saturating the core. When the core saturates, the transformer action is drastically reduced because the permeability of the core, when saturated, is not substantially greater than the permeability of air. Core saturation stops the oscillator operation and generates the ignition timing trigger pulse.

The operation of the oscillator 12 will now be described without reference to the effect of the magnetic disk assembly 14 and, specifically, its effect on the saturable core transformer 38. Without saturation of the transformer core, the oscillator is free running whenever the power source B is connected to the oscillator which occurs when the ignition switch 37 is closed. When the oscillator 12 is oscillating under steady state conditions, a large sinusoidal current circulates through the series circuit consisting of the resonant circuit L1 and C3, the secondary winding W3 of the transformer 38, the parallel combination of the first diode D1 and the emitter-base diode of the first transistor Q1 and the parallel combination of the second diode D2 and the emitter-base diode of the second transistor Q2. During one half of the cycle, the first diode D1 and the emitter-base diode of the second transistor Q2 are driven into conduction by the sinusoidal current, and during the other half of the cycle, the second diode D2 and the emitter-base diode of the first transistor Q1 are driven into conduction. Since the emitter-base diodes of the transistor Q1 and Q2 conduct on alternate half cycles, the transistors are driven into saturation on alternate half cycles producing essentially square wave voltages of opposite polarity at the collector of each transistor. The collector voltages at the first and second windings W1 and W2 comprise the source for the feedback signal for the series resonant circuit.

In order to achieve high frequency stability, the resistance in series with the resonant circuit comprising L1 and C3 must be low. This resistance includes the resistance reflected into the output winding W3 of the transformer 38. When the first transistor Q1 is conducting and the second transistor Q2 is nonconducting, the impedance reflected into the output winding W3 of the transformer 38 is low because of the shunting action of the low impedance emitter-collector path of the first transistor Q1 across the first transformer winding W1. Similarly, when the second transistor Q2 is conducting and the first transistor Q1 is not conducting, the impedance reflected into the output winding W3 of the transformer 38 remains low because of the shunting action of the low impedance emitter-collector path of the second transistor Q2.

Figure 2:
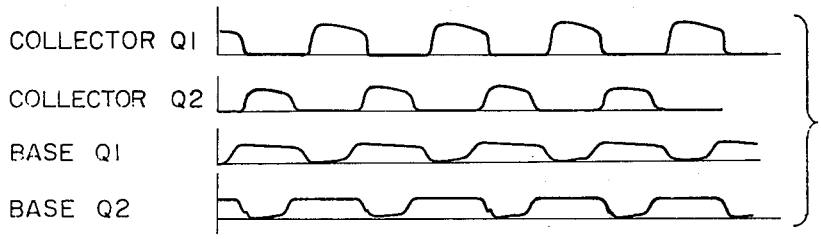
FIG. 2 is an illustration of the various idealized waveforms within the circuit of FIG. 1 when the oscillator is free running.

During the uninhibited oscillation, square wave outputs of opposite polarity are produced at each transistor collector due to the push-pull drive at the transistor bases. The base limiting diodes, D1 and D2 poled oppositely to the base-emitter transistor diode, insure low series impedance to the series resonant frequency determining circuit during each half-cycle of operation. Each transistor is alternately driven into saturation and cut-off such that essentially a continuous value of current is drawn from the power supply through the A.C. bypassed common resistor R3. The resistor R3 decouples the oscillator from the power source B, allowing the generation of an output pulse when circuit oscillation is terminated. The starting resistors R1 and R2 connected between base and collector circuits of the transistors Q1 and Q2, respectively, insure oscillation. When power is initially applied to the circuit, a positive voltage is provided via the starting resistors at the base, thereby causing the transistor to conduct. The resistors cause some secondary variations in the duty cycle due to the resulting positive bias offset, as noted in the waveform in FIG. 2 of the collector and base voltage of the Q1 and Q2 transistor. The waveforms in FIG. 2 are approximated. It is to be understood that the actual collector waveforms may contain low level spikes due to spurious high frequency damped oscillations. These spikes and the actual 2.2MHz oscillation signal are removed from the output signal by the filtering effect provided by the combination of R3 and C1.

Figure 3:
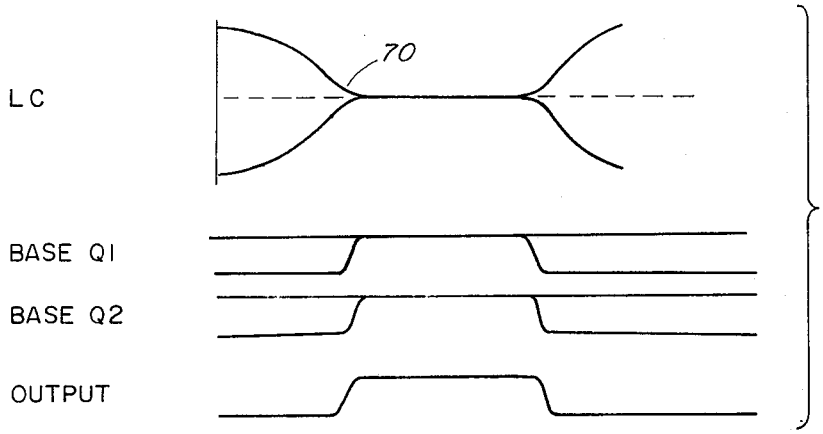
FIG. 3 is an illustration of the waveforms within the circuit of FIG. 1 when a trigger pulse is generated, the circuit being exclusive of the means for making the rise time of the pulses independent of the engine speed.
Figure 4:
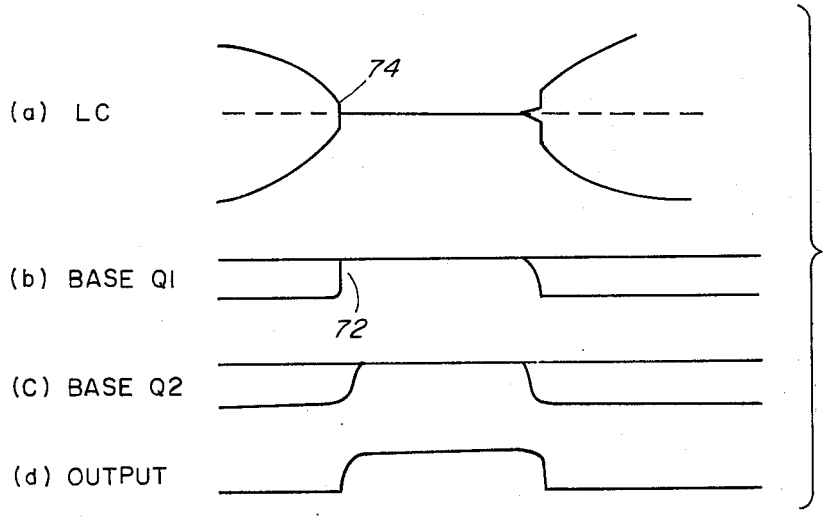
FIG. 4 is an illustration of the waveforms for fully implemented operation at nominal engine speeds.

The speed-up technique for generating reliable timing pulses, independently of the slow rotation velocity and limited instead to the circuit time constants, is best understood by first examining the dynamic operation for the balanced condition. As a magnet approaches the ferrite core transformer 38, it reduces the feedback coupling by the limiting effect of core saturation. Oscillation continues even as the level of oscillation diminishes toward zero which occurs when core saturation is complete as shown at 70 in the LC signal in FIG. 3. All of the waveforms in FIG. 3 and in FIG. 4 except the output waveform are of the envelopes of the peak amplitude in the various signals, such as those at the resonant circuit (LC), the base (Q1) and the base (Q2). When the drive signal LC (monitored at the series resonant circuit) falls below that required to maintain full limiting base drive at the base of transistors Q1 and Q2 which is in excess of the forward biased diode levels, the circuit is self-biased to a new conduction level while maintaining a steadily diminishing and balanced oscillation dependent upon the level of core saturation. The reduction in drive further causes an increase in base impedance, and linear oscillation is approached through the effective elimination of the limiting base diodes. The speed of the resultant decay is determined by the speed of the magnet relative to the saturable core, and at normal rotational velocity a positive going pulse of sufficient amplitude to trigger a spark generator is produced across the output resister as shown at the output waveform in FIG. 3. At a lower velocity, the rise time of the pulse appearing across the resistor is substantially increased, and at speeds approaching zero velocity only a slow DC level change occurs. It should be noted that the output waveform at FIG. 3 corresponds to the signal which is generated at normal engine speeds. The duration of the pulse is about 2 milliseconds. A capacitive load C4, connected across either base circuit, creates the condition of unbalance, which is responsible for the rapid turn-off that occurs at essentially zero magnet velocity during partial magnetic core saturation. The feature of the capacitor C4 speeds up what otherwise would be a slow DC level change at slow cranking speeds. Consider now the effect of loading either base to ground with an impedance at the oscillation frequency about comparable to the forward bias of the base diodes. Capacitive impedance is preferred because of bias conditions. During normal unsaturated-core operation, little effect other than a minor increase in rise time occurs at the loaded base since the oscillation level is sufficiently great to insure base limiting. As magnetic core saturation occurs and reduces the drive below the limiting voltage level of the paralleled diodes, a rapid collapse in base drive occurs at the capacitively loaded base in contrast to the normal slow decay which continues essentially unchanged on the unloaded side. The base diodes are non-linear elements, the impedance of which is dependent upon the level of base drive. When the drive is reduced, both diodes assume new and higher impedance levels. However, the impedance of the capacitively loaded side remains substantially fixed due to the impedance of the capacitor at the frequency of interest; i.e., the oscillation frequency 2.2MHz. Since the bases are essentially series connected across the feedback winding, and in a balanced circuit each receives half of the available drive, any unbalance in circuit impedance causes a corresponding unbalanced base drive such that at the moment when the drive level falls below the limiting diode voltage, the resulting impedance unbalance causes the signal division as shown in the base waveforms of base Q1 and base Q2 in FIG. 4. With the termination of base drive at the loaded base, the transistor rapidly self-biases itself to the "cut-off" value of collector current, producing the desired voltage step across the output resistor. The collapse in base voltage is shown at 72 and is reflected into the LC circuit signal as shown at 74.

The following are the values or identification of the various components and operating conditions of the circuit of FIG. 1.

| | |
|---|---|
| oscillation frequency | 2.2MHz |
| duration of output pulse | 2 Msec. |
| supply voltage | 12 volts DC |
| diodes D1 and D2 | HP82 |
| transistors Q1 and Q2 | 2N2218 |
| R1 and R2, | 47K ohms |
| R3, | 68 ohms |
| L1, | 52 $\mu$ henries |
| C1, | 1.0 $\mu$ farads |
| C2, | 1.0 $\mu$ farads |
| C3, | 100 $\mu\mu$ farads |
| C4, | 330 $\mu\mu$ farads |
| ferrite core | RCA No. 226-M1 |
| windings (W1, W2, W3) | each 9 turns of No. 41 wire |

The embodiment of the present invention is merely exemplary and those skilled in the art will be able to make numerous variations and modifications without departing from the spirit of the present invention. All such variations and modifications are intended to be included within the scope of the present invention as defined in the following claims.

We claim:

1. An improvement in an ignition system for an internal combustion engine of the type having an ignition coil and a device for synchronously distributing the voltage output of the coil to a plurality of sparkplugs comprising, a. an oscillator comprising 1. first and second transistors each having first, second and third electrodes respectively, the first electrodes of the first and second transistors being coupled together,
2. a series resonant circuit having first and second ends, the first end being coupled to the third electrode of the first transistor,
3. a transformer having a saturable core and a first, second and third winding disposed around the core, each winding having a first and second terminal, the first terminals of the first and second transistors, respectively, and the second terminals of the first and second windings being coupled together to define a centertap, the first terminal of the third winding being coupled to the second end of the resonant circuit and the second terminal of the third winding being coupled to the third electrode of the second transistor, the third winding providing a feedback signal for the oscillator,
4. a first and second diodes coupled across the first and third electrodes of the first and second transistors respectively,
5. a loading capacitor coupled across one of the first and second diodes,
6. a resistance coupled power source connected to the centertap,
7. an output capacitor coupled between the ignition coil and the centertap and, b. means for periodically saturating the transformer core in synchronism with the engine speed to interrupt the feedback signal to the oscillator and to provide an output pulse to the ignition coil.

2. The system according to claim 1, further including at least one resistor coupled across the second and third electrodes of one of the first and second transistors.

3. The system according to claim 1, further including a second capacitor coupled between the centertap and the coupled first electrodes of the transistors.

4. The system according to claim 1, wherein the saturating means includes a disk having a periphery disposed in the vicinity of the core, means for rotating the disk at the same speed as that of the engine and a plurality of permanent magnets disposed around the periphery of the disk, the magnetic field from each magnet saturating the core as the magnet moves through the vicinity of the core.

5. The system according to claim 1, wherein the transformer core is in the shape of a torroid and is made of a magnetically soft ferrite material.

* * * * *

PO-1050
(5/69)

UNITED STATES PATENT OFFICE
CERTIFICATE OF CORRECTION

Patent No. 3,973,545 Dated August 10, 1976

Inventor(s) Martin Fischman and John Matarese

It is certified that error appears in the above-identified patent and that said Letters Patent are hereby corrected as shown below:

Col. 7, line 19, "resister" should read --resistor--.
Col. 8, line 45, before "transistors" insert --windings being coupled to the second electrode of the first and second--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*